US007789973B1

(12) United States Patent
Barton

(10) Patent No.: US 7,789,973 B1
(45) Date of Patent: Sep. 7, 2010

(54) UTILITY WASHER

(76) Inventor: Frances B. Barton, 937 Green St., Phillipsburg, NJ (US) 08865-3418

( * ) Notice: Subject to any disclaimer, the term of this patent is extended or adjusted under 35 U.S.C. 154(b) by 828 days.

(21) Appl. No.: 11/708,754

(22) Filed: Feb. 21, 2007

(51) Int. Cl.
*B08B 3/00* (2006.01)

(52) U.S. Cl. ..... 134/58 R; 134/94.1

(58) Field of Classification Search ..... None
See application file for complete search history.

(56) References Cited

U.S. PATENT DOCUMENTS

| | | | | |
|---|---|---|---|---|
| 2,750,229 | A * | 6/1956 | Cammann | 239/229 |
| 3,752,322 | A * | 8/1973 | Fiocca et al. | 211/41.8 |
| 6,869,029 | B2 | 3/2005 | Ochoa, Sr. et al. | |
| D510,781 | S | 10/2005 | Seo et al. | |
| 2001/0017145 | A1 | 8/2001 | Rosenbauer et al. | |
| 2003/0037809 | A1 | 2/2003 | Favaro | |
| 2005/0150528 | A1 | 7/2005 | Kim | |
| 2006/0060227 | A1 | 3/2006 | Han et al. | |

FOREIGN PATENT DOCUMENTS

| | | | |
|---|---|---|---|
| EP | 1502535 | A2 * | 2/2005 |
| KR | 1995-0013459 | A * | 6/1995 |

OTHER PUBLICATIONS

Lee, Je-Yeol, Jun. 1995, KR1995-0013459, English machine translation.*

* cited by examiner

*Primary Examiner*—Michael Barr
*Assistant Examiner*—Jason Y Ko

(57) ABSTRACT

Disclosed is a utility washer that may be electrically controlled to clean articles. The utility washer may include a housing having an interior that may include nozzles and a rack supported by rails, where the nozzles may include top nozzles and bottom nozzles. The utility washer further may include a door connected to the housing, where the door may include a removable exterior panel and a hose behind the removable exterior panel. The hose may be connected to a hose attachment at one end and may be configured to draw up liquid into the hose from an open second end. The utility washer further may include control switches attached to the door having settings for water temperature, water/steam force, wash/cleaning level, position of articles within the utility washer, and drying.

17 Claims, 6 Drawing Sheets

UTILITY WASHER

BACKGROUND

1. Field

The information disclosed relates to an electrically controlled machine to clean articles, such as odd-sized, awkwardly-shaped, and unhygienic articles.

2. Background Information

A dishwashing machine may be thought of as a mechanical device to clean utensils used in preparing and serving food. Unlike manual dishwashing, which relies largely on human physical scrubbing of dishes, pots, pans, and the like to remove adherent dirt, scale, tarnish, impurities or any other foreign or undesired matter, a mechanical dishwasher typically cleans by spraying hot (55-65 degrees Celsius or 130-150 degrees Fahrenheit) water on food utensils. As there may be no human contact during the dishwashing machine process, strong detergents may be used which may be too alkaline for habitual exposure to the skin. Some dishwashing machines also contain a heating element to achieve fast drying of the dishes.

The size, shape, and components of a typical dishwashing machine are configured for common food utensils such as dishes, pots, and pans. This prevents utilizing the machine to clean a variety of odd-sized and awkwardly-shaped household items that typically are cleaned by hand. In addition, hygienic propriety keeps many consumers from utilizing their dishwashing machine to clean items such as toilet plungers, litter boxes, small garbage cans, cooking grids from grills, and toilet brushes. Many would prefer to dispose of a used toilet brush than to touch it to clean it by hand.

There is a need to overcome these and other problems.

SUMMARY

Disclosed is a utility washer that may be electrically controlled to clean articles. The utility washer may include a housing having an interior that may include nozzles and a rack supported by rails, where the nozzles may include top nozzles and bottom nozzles. The utility washer further may include a door connected to the housing, where the door may include a removable exterior panel and a hose behind the removable exterior panel. The hose may be connected to a hose attachment at one end and may be configured to draw up liquid into the hose from an open second end. The utility washer further may include control switches attached to the door having settings for water temperature, water/steam force, wash/cleaning level, position of articles within the utility washer, and drying.

DETAILED DESCRIPTION

Figure 1:
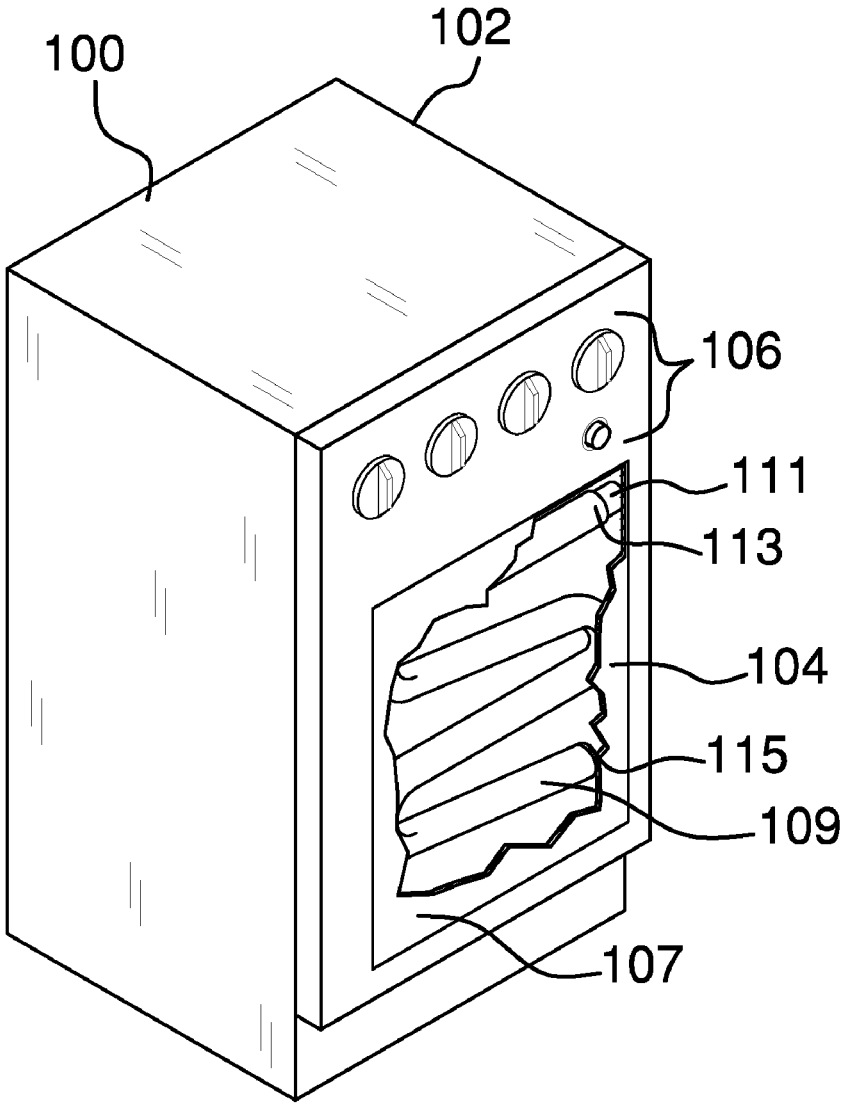
FIG. 1 is an isometric view of utility washer 100.

FIG. 1 is an isometric view of utility washer 100. Utility washer 100 may be an electrically controlled machine configured to clean articles, such as odd-sized, awkwardly-shaped, and unhygienic articles typically found in a household. Such articles may include toilet plungers, litter boxes, small garbage cans, cooking grids from grills, and toilet brushes.

Utility washer 100 may include a housing 102, a door 104, and control switches 106. Housing 102 may be a protective cover that may contain and support mechanical component of utility washer 100. Housing 102 may be rectangular or square. In one example, housing 102 may measure 2½ by 3½ by 4 feet. In another example, a height of housing 102 may be from 3½ to 4 feet and a length of housing 102 may be from 2 to 2½ feet.

Door 104 may be a structure in housing 102 configured to allow easy conversion between an opened and a closed utility washer 100. Control switches 106 may be devices that may permit a user to communicate with and configure system settings (FIG. 3) for utility washer 100. Such system settings may relate to water temperature, water/steam force, wash/cleaning level, position of articles within utility washer 10C, and drying.

Door 104 may include an exterior panel 107 behind which may be a door hose 109 and attachments housed within door 104. Opening exterior panel 107 of door 104 may permit access to door hose 109. Maintaining door hose 109 within an interior of door 104 may keep debris from getting caught in between hose loops and attachment, where the debris may grow mold and bacteria, for example. Maintaining door hose 109 within an interior of door 104 also may keep door hose 109 and attachments from experiencing high heat that may be generated during a washing.

Door hose 109 may be supplied with utility washer 100 to be connected to a door hose attachment 111 so that utility washer 100 may draw up liquid spills and the like, similar to a wet-vac. Door hose 109 may be connected to door hose attachment 111 at a first end 113 and may be configured to draw up liquid into door hose 109 from a second, open end 115. Here, water may be pumped from door hose 109 into drain tube 13E (FIG. 4), which may be useful in the event of a basement flooding. Utility washer 100 may send flow both ways through door hose 109 and water also may be pumped from door hose attachment 111 into door hose 109 to spray water on articles. When utilizing door hose 109 to spray water on articles, an end of door hose 109 may be fixedly positioned during a cycle of utility washer 100.

Figure 2:
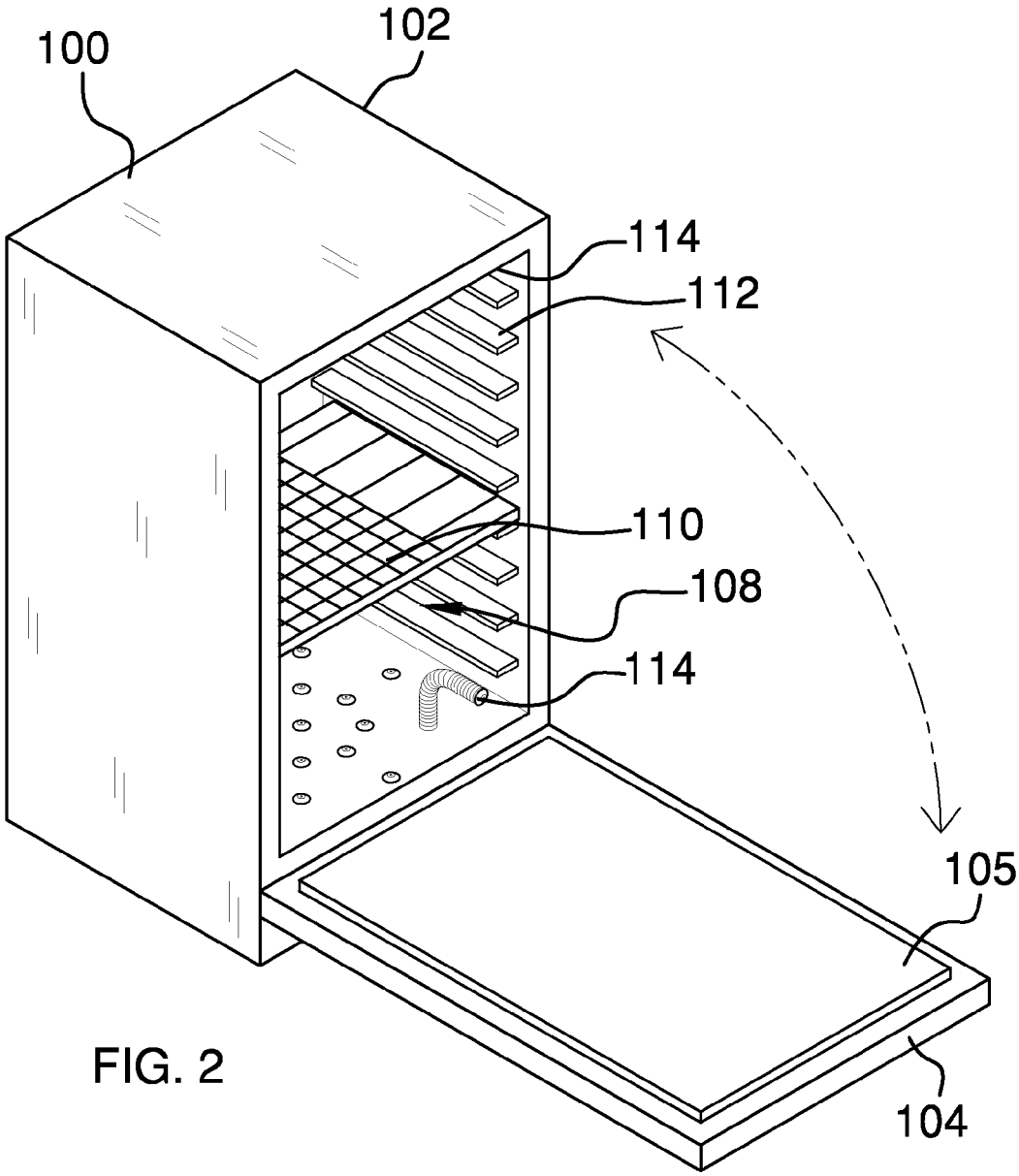
FIG. 2 is an isometric view of utility washer 100 with door 104 in an open position.

FIG. 2 is an isometric view of utility washer 100 with door 104 in an open position. With door 104 in this open position, a user may access an interior 108 of housing 102. Door 104 may include an elevated portion 105 configured to fit within interior 108 when door 104 is closed. Utility washer 100 further may include racks 110, rails 112, and nozzles 114.

Racks 110 may be frameworks for holding articles. Rails 112 may be members that support racks 110. In one example, utility washer 100 may include nine pairs of rails 112. Nozzles 114 may be orifices through which streams of water may be directed and controlled. In one example, at least two nozzles 114 may be flexibly curved, Gooseneck-style nozzles 114 that may be configured to a variety of predetermined positions to train high pressure streams of water toward selected articles. Elevated portion 105 of door 104 may be configured to align each rack 110 when door 104 is in a closed position.

Figure 3:
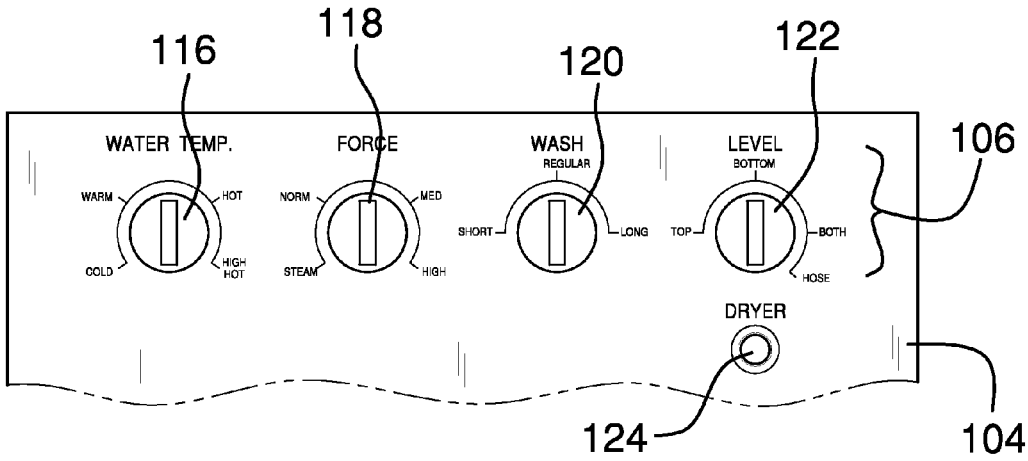
FIG. 3 is detailed front view of control switches 106 of FIG. 1.

FIG. 3 is detailed front view of control switches 106 of FIG. 1. Control switches 106 may include a water temperature switch 116, a force switch 118, a wash switch 120, a level switch 122, and a dryer switch 124. Water temperature switch 116, force switch 118, wash switch 120, and level switch 122 each may include a knob configured to rotate into at least three predefined positions to help facilitate the operation utility washer 100. Dryer switch 124 may be an electrical switch operated by pressing. Settings for control switches 106 may include: Water temperature switch 116 (cold, warm, hot, high hot), Water/steam force switch 118 (steam, normal, medium, high), Wash cycle switch 120 (short, regular, long), and Wash levels switch 122 (top, bottom, full, hose (using hose attachment port 148 and top sprayers 114)).

Water temperature switch 116 may have four settings for low and high temperatures: cold, warm, hot, and high hot. In this regard, water temperature switch 116 may control the temperature of water distributed from nozzles 114 (FIG. 2). Utility washer 100 may include a gentle (no heat) cycle for non-dishwasher safe items. Utility washer 100 may include a gentle (high heat) cycle for disinfecting, to clean rugs, shoes, contaminated toys and work gloves.

The cold setting may be utilized to rinse off mud and dust and for gentle cleaning. The warm setting may be utilized for gentle cleaning. The hot setting may be utilized for heavy cleaning for cleaning mud, dirt, and dust. The high hot setting may provide disinfection to articles within interior 108 for cleaning items such as soiled shoes, contaminated toys, and also cleaning grease or grime within interior 108.

Force switch 118 may have four settings (steam, normal, medium, and high) to control the pressure with which water may be distributed from nozzles 114. The steam setting may be utilized for items that should not get wet, such as boots, or for any article that may need steam cleaning. The normal force setting may be utilized for normal water pressure, such as with the high hot setting of water temperature switch 116 to clean bathroom garbage cans. The medium force setting may be utilized to produce water pressure in between the normal and high force settings. The high force setting may be utilized for a blast force to help remove gunk, for example. In addition, the high force setting may be utilized with the high hot setting of water temperature switch 116 to clean barbecue grill parts and automobile hubcaps. The high force setting of force switch 118 may be utilized to remove hardened grease, dirt, and grime.

Wash switch 120 may have three settings—short, regular, and long. The short setting may be utilized to rinse, wash, and finally a rinse. The regular setting may be utilized to rinse, wash, rinse, wash again, and finally rinse. The long setting may be utilized for a longer rinse than for the medium setting, a longer wash than the medium setting, a rinse, a wash, and a final rinse.

Level switch 122 may have four settings—top, bottom, both, and hose. The top setting may utilize top nozzles 114, the bottom setting may utilize bottom nozzles 114, and the both setting may utilize all nozzles 114. The hose setting may utilize hose attachment port 148 and top sprayers 114. The hose setting also may be referred to as a hydrant setting such that the setting for level switch 122 may include top, bottom, both, hydrant (or hydrant port). Dryer switch 124 may activate elements within housing 102 that may generate heat to dry articles after cleaning. In addition, dry switch 124 may remove moisture from interior 108 to dry interior 108.

Figure 4:
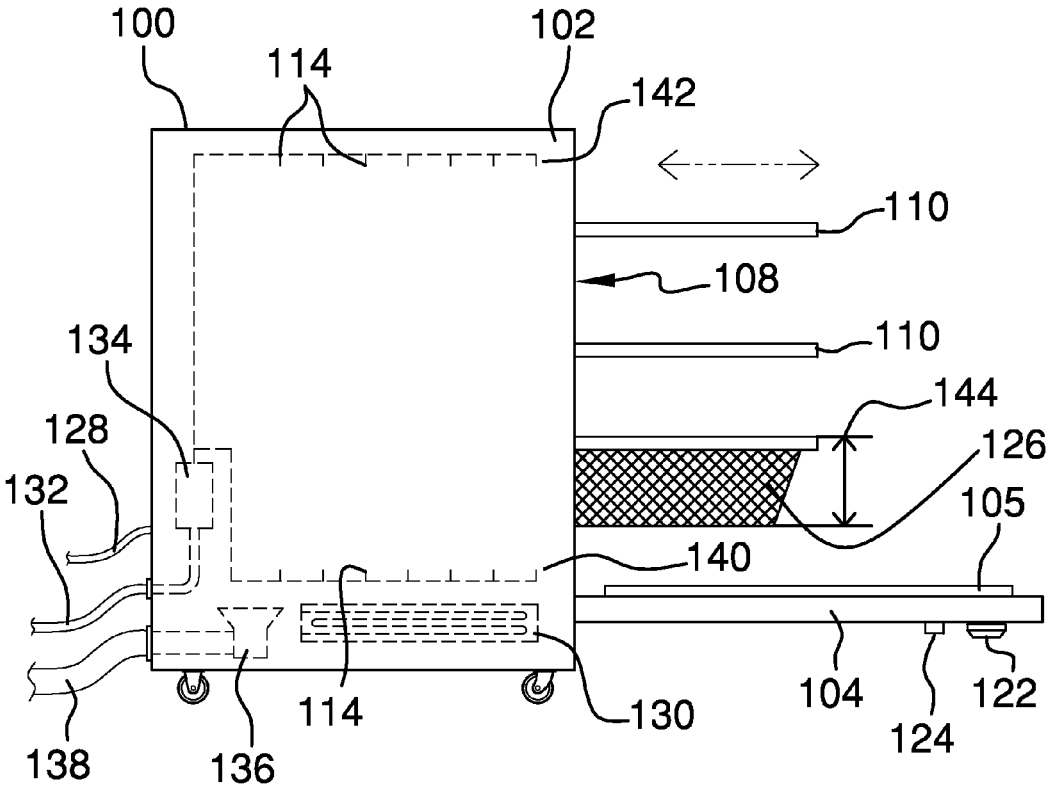
FIG. 4 is a side view of utility washer 100 and a partial schematic view of system components within utility washer 100.

FIG. 4 is a side view of utility washer 100 and a partial schematic view of system components within utility washer 100. Racks 110 may be extended out of interior 108 for loading and unloading. Tines attached to each rack may be positioned upward or closed flat. In one example, all prongs or tines may be positioned up, ½ of all tines may be positioned up, or all tines may be positioned closed flat. Utility washer 100 additionally may include a basket 126, a power cord 128, a heating element 130, a water source tube 132, a pump 134, a drain 136, and a drain tube 138. As in FIG. 4, nozzles 114 may be positioned near a lower end 140 of interior 108 and an upper end 142 of interior 108. Nozzles 114 located near upper end 142 may be configured to spray downwards.

Level switch 122 may select nozzles 114 located near upper end 142, near lower end 140, or a combination thereof. In particular, the settings for level switch 122 may aid in targeting the streams of water from nozzles 114 towards the positions of articles-to-be-cleaned within interior 108. For example, for the top wash setting, nozzles 114 located near upper end 142 may be referred to as top nozzles and they may be utilized by the top wash setting. For the bottom wash setting, nozzles 114 located near lower end 140 may be referred to as bottom nozzles and they may be utilized by the bottom wash setting. Each nozzle 114 may have a water shoot attachment such that tanks (such as humidifiers, dehumidifiers, and rug cleaner tanks) may be located over a shoot attachment to receive intermittent bursts of high pressure water. Each shoot attachment may be snapped into place. For the normal wash setting (norm), all nozzles 114 may be utilized.

Basket 126 may be an openwork container having a depth 144 to receive sized articles-to-be-cleaned. In one example, depth 144 may be approximately five inches. Basket 126 may include tines that pivot between an upward position and a flat position. More than one basket 126 may fit within interior 108. Basket 126 may be positioned on a rack 110 and may snap secure in position. Basket 126 may include a lid to secure articles within basket 126. The lid may have an openwork pattern similar to an openwork pattern of sidewalls of basket 126. A size of the openwork pattern may be small enough to permit basket 126 to retain small items such as coins, marbles, and toy match cars. In one example, the open spaces within an openwork pattern of basket 126 may be smaller than the open spaces of an openwork pattern of racks 110.

Power cord 128 may be an insulated conductor configured to guide power to electrical components of utility washer 100. Heating element 130 may be a device configured to receive electricity from power cord 128 and supply heat to interior 108 as a function of dryer switch 124 (FIG. 3). Water source tube 132 may be a long hollow object configured to conduct water to water components of utility washer 100. Pump 134 may be a device configured to receive water from water source tube 132 and move that water into and through nozzles 114. In one example, pump 134 may be an electrically operated pump. In another example, pump 134 may create a high pressure within water supplied to utility washer 100 to clean hard to reach gunk.

Drain 136 may be a pipe through which liquid may be carried away from interior 108. Drain tube 138 may be a long hollow object configured to conduct water away from drain 136. In one example, pump 132 and drain tube 138 may be configured to accommodate large sized and large quantity abrasive dirt particles. In other words, drain tube 138 may be large enough for mud chunks, grease chunks, and good chunks to pass through drain tube 138. To achieve this, an interior diameter of drain tube 138 may not be less than three inches.

Utility washer 100 may include hanging clips configured to open against a spring and close with the spring to hang floor mats, car mats, gloves, and the like. An upper ceiling of interior 108 may include loops and/or hooks for hanging articles.

Figure 5:
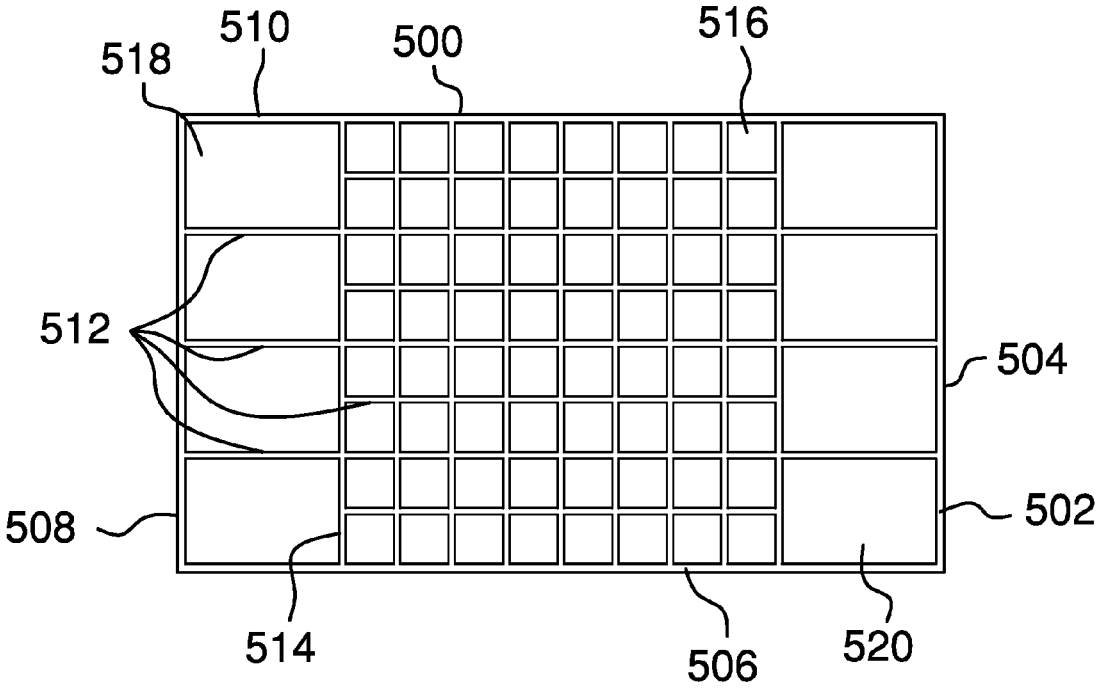
FIG. 5 is a plan view of a rack 500.

FIG. 5 is a plan view of a rack 500. Rack 500 may be one rack of racks 110. Rack 500 may include a frame 502 having a first side 504, a second side 506, a third side 508, and a fourth side 510. Within frame 502 may be horizontal elements 512 and vertical elements 514. Horizontal elements 512 and vertical elements 514 may be arranged to create an openwork lattice having a set of small openings 516 and a first set of large openings 518 and a second set of large openings 520. In one example, nine vertical elements 514 intersect seven horizontal elements 512 to form sixty-four small openings 516 and four large openings 518 and four large openings 520. In another example, the small openings 516 measure approximately one-inch square and the large openings 518, 520 measure six inches by four inches.

Figure 6:
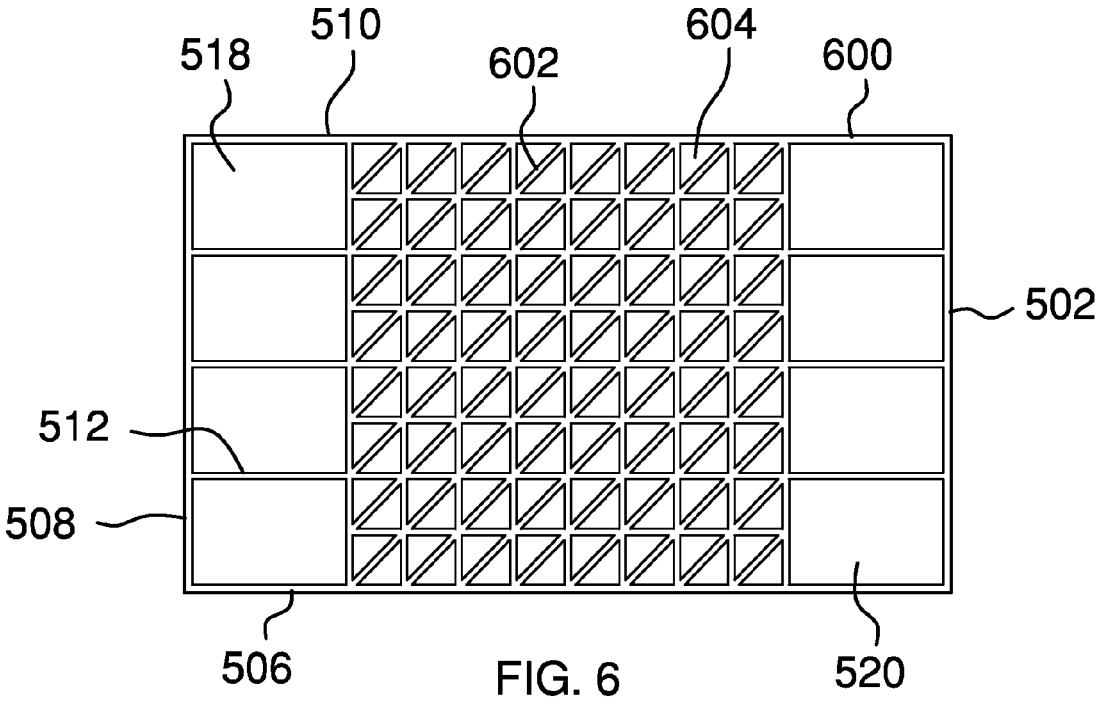
FIG. 6 is a plan view of a rack 600.

FIG. 6 is a plan view of a rack 600. Rack 600 may include elements in common with rack 500 and additionally include diagonal elements 602. Diagonal elements 602 may bisect small openings 516 to create small openings 604. In one example, rack 600 may include fifteen diagonal elements 602. In an alternate embodiment, diagonal elements 602 may be tines that may be located in an upward position or located flat to for diagonal elements 602.

Figure 7:
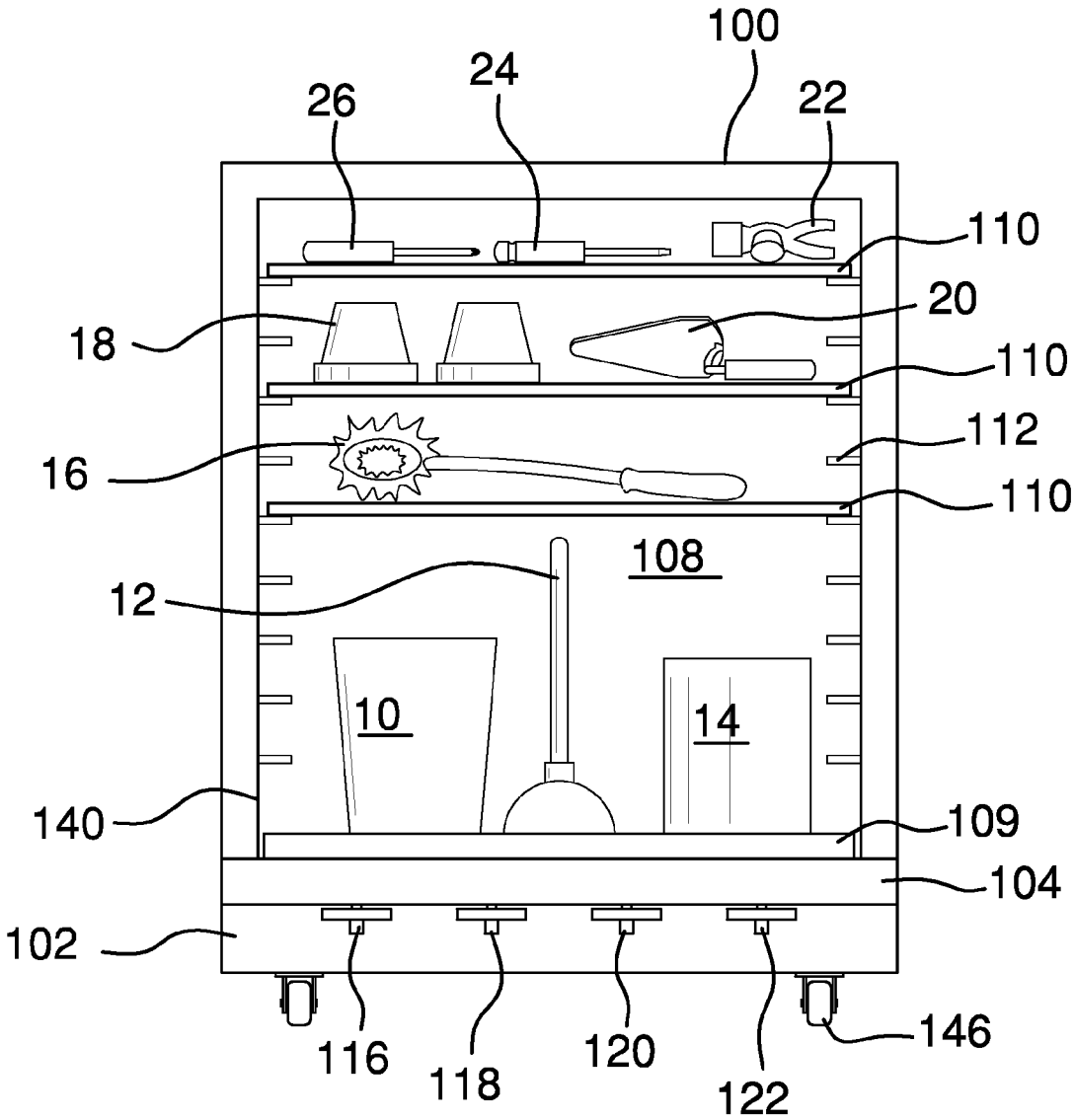
FIG. 7 is a front view of utility washer 100 with door 104 located in an open position.

FIG. 7 is a front view of utility washer 100 with door 104 located in an open position. Utility washer 100 additionally may include casters 146. Casters 146 may be pivoted wheels fastened to frame 102 to facilitate movement of utility washer 100. In one example, utility washer 100 may include four casters 146. In another example, utility washer 100 does not include four casters 146 such that a user would not move utility washer 100 around from room to room like a dehumidifier or a wet/dry vac. Like a dishwasher, refrigerator or washer and dryer, utility washer 100 may stay where it is placed.

Racks 110 may be removed and a height of each rack 110 may be adjusted or combination of racks 110 may be employed utilizing the different rails 112. This may accommodate items as large as a kitchen garbage can or as small as automotive tools. For example, with three racks 110 arranged inside interior 108, interior 108 may be of a size sufficient to receive a waste basket 10, a toilet plunger 12, a small garbage can 14, a toilet brush 16, a container in which plants may be cultivated, here pots 18, spade or trowel 20, and tools such as hammer 22, flat head screwdriver 24, and Phillips screwdriver 26. Other work shed tools may fit as well. Racks 110 may include tines that independently may be position from vertical to horizontal (fiat).

In one example, a floor just above lower end 140 may be a permanently installed rack 110. This may be useful to keep large articles that just fit inside interior 108 from blocking water in and water out operations. A bottle rack may be included with utility washer 100.

Figure 8:
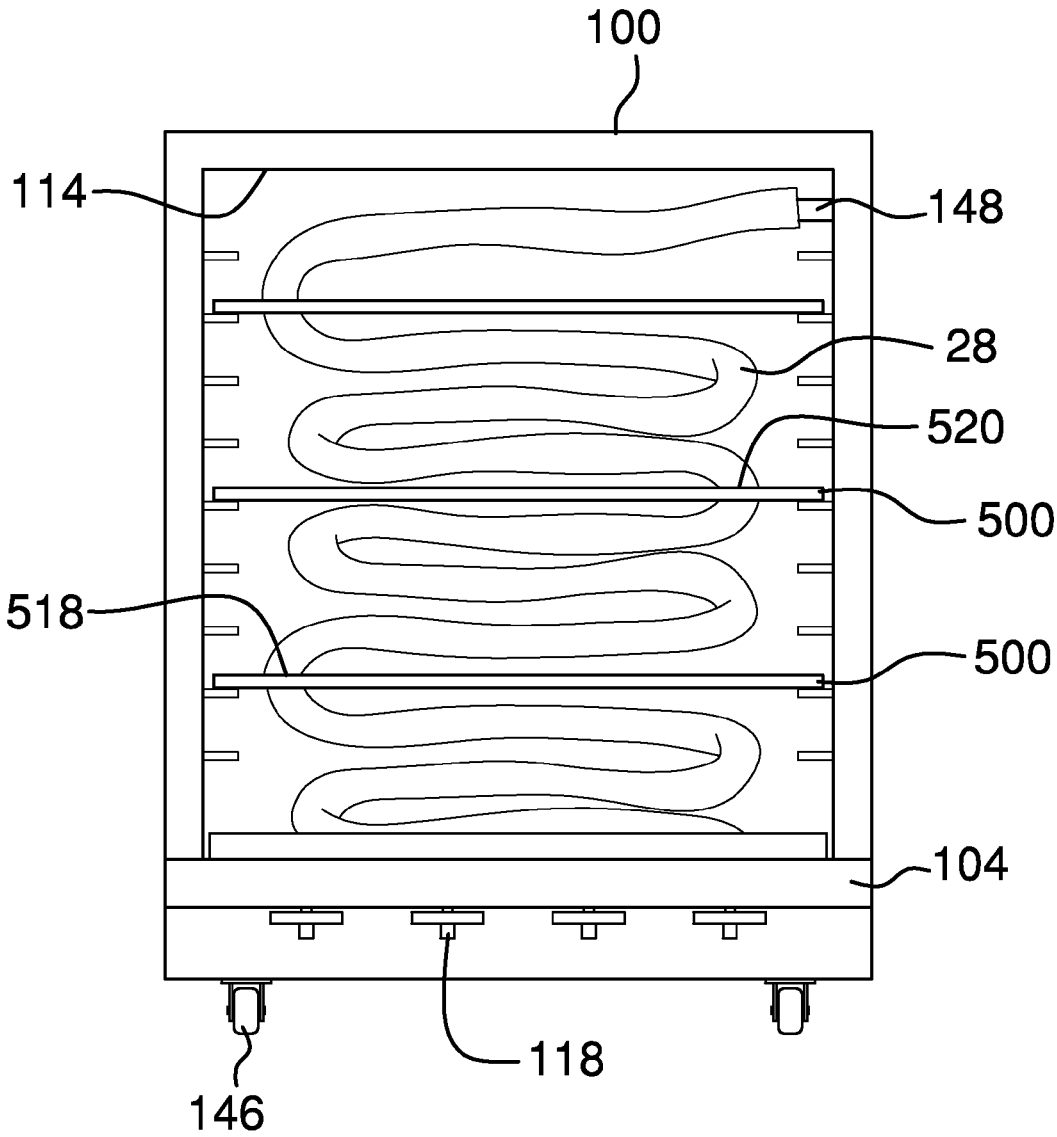
FIG. 8 is a front view of utility washer 100 with door 104 located in an open position.

FIG. 8 is a front view of utility washer 100 with door 104 located in an open position. Utility washer 100 additionally may include a hose attachment 148. Hose attachment 148 may be a pipe through which liquid may be pumped. The high setting for force switch 118 (FIG. 3) may be utilized with hose attachment 148.

Water may be pumped from hose attachment 148 into a vacuum hose 28 for example, in order to clean an interior of vacuum hose 28. The hose setting may shoot water through port 148 to clean any hose that may be attached to port 148 and may utilize the top nozzles 114 to wash the outside of the hose. When cleaning vacuum hose 28, vacuum hose 28 may be thread through first set of large openings 518 and second set of large openings 520 of racks 500 of FIG. 5. The high force setting of force switch 118 (FIG. 3) may be utilized to force sufficient volumes of water through hose 28. Hose attachment 148 may include a stepped or flexible connector that may be utilized to link typically-sized vacuum cleaner hoses 28.

The utility washer may be a household appliance design that may be used to clean odd-sized and shape items. These items may include automotive parts such as hubcaps and floor mats, bathroom garbage cans, camping cookware and tent stakes, carpet cleaner tanks, dehumidifier tank, fireplace tools such as poker, shovel, and tongs, garden tools, grill components such as cooking grids and brushes from grills, humidifier parts and tank, litter boxes, muddy boots, range hood grease traps and filter grids, rug cleaning machine removable parts, rugs and floor mats, scoops and other implements used to handle animal waste, shoes having dog poop attached, small garbage cans, toilet brush and stand, toilet plungers, tools, toys, and vacuum cleaner hoses and other removable parts of a vacuum cleaner.

The utility washer may fulfill a need for an appliance that may clean a variety of household items that typically may be cleaned by hand. Appealing features of the utility washer may include convenience, versatility, and ease of use. The utility washer may be able to automatically and thoroughly wash a variety of household items largely incapable of being handled by conventional washing machines. It may be fairly easy to operate and may likely result in the use of less water for these purposes.

The utility washer may be ideal for a mud room, utility room, or basement. Its overall size and shape may be varied. The utility washer may be run once a week, once a month, and even once a year to clean household items. Since the utility washer need not be run once a day, the utility washer may be cost efficient. The utility washer may be run whenever a user has a messy job to minimize the effort need to clean up that mess.

Typically you would not want to clean these household items by hand but it was necessary because there was no other means to wash them. The only alternative to washing by hand would be to throw away the item to be cleaned and purchase a new one. For example, no one wants to wash a toilet bowl brush and stand by hand. Either the apprehension of washing these items by hand is over come or they are thrown away. The utility washer provides a way to keep the item and clean the item without touching the item, thus saving money and preventing one more toilet bowl brush and stand from entering a garbage dump. Thus, the utility washer not only saves money, but is good for the environment.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A utility washer, comprising:

a housing having a housing interior that includes nozzles and a rack supported by rails, where the nozzles include top nozzles and bottom nozzles;

a door connected to the housing to removably cover an opening to the housing interior, where the door includes a removable exterior panel covering a door interior and a door hose where the removable exterior panel is accessible from outside the housing when the door is closed and the door hose is located completely within the door interior behind the removable exterior panel, where the door hose is connected at a first end to a door hose attachment fixed within the door interior, and where the utility washer is configured to draw up liquid into an open second end of the door hose through the door hose and then into the door hose attachment; and control switches attached to the door, where the control switches include settings for water temperature, water/steam force, wash/cleaning level, position of articles within the utility washer, and drying.

2. The utility washer of claim 1, where the control switches include a water temperature switch, a force switch, a wash switch, a level switch, and a dryer switch.

3. The utility washer of claim 2, where settings for the control switches include at least two sets from the following sets: (i) a cold setting, a warm setting, a hot setting, and a high hot setting, (ii) a steam setting, a normal setting, a medium setting, and a high setting, (iii) a short setting, a regular setting, and a long setting, and (iv) a top setting, a bottom setting, a full setting, and a hose setting.

4. The washer of claim 3, where settings for the control switches include (iv) the top setting, the bottom setting, the full setting, and the hose setting, where the interior of the housing further includes a hose attachment port, where the hose setting is configured to utilize both the hose attachment port by shooting water through the hose attachment port and configured to utilize the top nozzles by spraying water out from the top nozzles.

5. The utility washer of claim 1, where the utility washer further comprising:

a basket within the interior of the housing;

a power cord connected to the housing;

a heating element within the interior of the housing;

a water source tube within the housing;

a pump within the housing connected to the water source tube;

a drain connected to the interior of the housing; and a drain tube connected to the drain, where an interior diameter of the drain tube is not less than three inches, whereby the drain tube provides an advantage of receiving mud chunks and grease chunks there through.

6. The utility washer of claim 5, where the basket is an openwork container having a depth that is approximately five inches.

7. The utility washer of claim 1, further comprising:

a drain tube connected to a drain, where an interior diameter of the drain tube is not less than three inches, whereby the drain tube provides an advantage of receiving mud chunks and grease chunks there through.

8. The utility washer of claim 1, where the rack includes a frame having horizontal elements and vertical elements, where no more than nine vertical elements intersect seven horizontal elements to form sixty-four small openings and eight large openings that are larger than the sixty-four small openings, whereby the large openings provide the advantage of receiving a vacuum hose threaded through the large openings for cleaning of the vacuum hose.

9. The utility washer of claim 8, where the sixty-four small openings further include a diagonal element that bisects the small openings.

10. The utility washer of claim 9, where each diagonal element is a tine configured to be located in one of an upward vertical position and a flat horizontal position.

11. The utility washer of claim 10, where there are nine pairs of rails.

12. The utility washer of claim 11, where at least two nozzles are flexibly curved, Gooseneck-style nozzles, each of which is configured to be positioned in a predetermined position to train high pressure streams of water toward selected preselected articles.

13. The utility washer of claim 1, where the housing approximately measures 2½ by 3½ by 4 feet.

14. The utility washer of claim 1, where approximately a height of the housing measures from 3½ to 4 feet and a length of the housing measures 2 to 2½ feet.

15. A utility washer, comprising:

a housing having a housing interior that includes nozzles and a rack supported by rails, where the nozzles include top nozzles and bottom nozzles;

a door connected to the housing to removably cover an opening to the housing interior, where the door includes a removable exterior panel covering a door interior and a door hose where the removable exterior panel is accessible from outside the housing when the door is closed and the door hose is located completely within the door interior behind the removable exterior panel, where the door hose is connected at a first end to a door hose attachment fixed within the door interior, and where the utility washer is configured to draw up liquid into an open second end of the door hose through the door hose and then into the door hose attachment; and control switches attached to the door, where the control switches include settings for water temperature, water/steam force, wash/cleaning level, position of articles within the utility washer, and drying;

a basket within the interior of the housing;

a power cord connected to the housing;

a heating element within the interior of the housing;

a water source tube within the housing;

a pump within the housing connected to the water source tube;

a drain connected to the interior of the housing; and a drain tube connected to the drain, where an interior diameter of the drain tube is not less than three inches, whereby the drain tube provides an advantage of receiving mud chunks and grease chunks there through.

16. The utility washer of claim 15, where settings for the control switches include (iv) the top setting, the bottom setting, the full setting, and the hose setting, where the interior of the housing further includes a hose attachment port, where the hose setting is configured to utilize both the hose attachment port by shooting water through the hose attachment port and configured to utilize the top nozzles by spraying water out from the top nozzles.

17. The utility washer of claim 16, where there are nine pairs of rails.

* * * * *